US008333310B2

(12) United States Patent
Tages

(10) Patent No.: US 8,333,310 B2
(45) Date of Patent: Dec. 18, 2012

(54) FIXED ROTATING CLIP AND METHOD THEREOF

(75) Inventor: Fernando J. Tages, Coral Springs, FL (US)

(73) Assignee: A.G. Findings & Mfg. Co., Inc., Fort Lauderdale, FL (US)

( * ) Notice: Subject to any disclaimer, the term of this patent is extended or adjusted under 35 U.S.C. 154(b) by 384 days.

(21) Appl. No.: 12/701,029

(22) Filed: Feb. 5, 2010

(65) Prior Publication Data

US 2010/0200628 A1 Aug. 12, 2010

Related U.S. Application Data

(60) Provisional application No. 61/152,000, filed on Feb. 12, 2009.

(51) Int. Cl.
*A45F 5/00* (2006.01)

(52) U.S. Cl. ..... 224/197; 224/666; 224/668; 224/930

(58) Field of Classification Search ..... 224/197–200, 224/666–669, 672, 930; 24/3.11, 3.12; 403/97
See application file for complete search history.

(56) References Cited

U.S. PATENT DOCUMENTS

| | | | | |
|---|---|---|---|---|
| 5,806,146 | A * | 9/1998 | Chen | 24/3.11 |
| 6,029,871 | A * | 2/2000 | Park | 224/197 |
| 6,637,631 | B2 * | 10/2003 | Lafoux et al. | 224/197 |
| 6,752,299 | B2 * | 6/2004 | Shetler et al. | 224/197 |
| 6,948,197 | B1 * | 9/2005 | Chen | 5/93.1 |
| 2006/0237495 | A1 * | 10/2006 | Chen et al. | 224/197 |

* cited by examiner

*Primary Examiner* — Justin Larson
*Assistant Examiner* — Adam Waggenspack
(74) *Attorney, Agent, or Firm* — Christopher & Weisberg, P.A.

(57) ABSTRACT

A clip assembly for a mobile device case. The clip assembly includes a base having an opening there through, the base is mountable to the mobile device case. An arm is also included having a projection disposable within the opening and a recess. The arm is rotatable about the base. A lock is also included, the lock is insertable into the recess to secure the arm to the base.

9 Claims, 7 Drawing Sheets

FIXED ROTATING CLIP AND METHOD THEREOF

CROSS-REFERENCE TO RELATED APPLICATION

This application is related to and claims priority to U.S. Provisional Patent Application Ser. No. 61/152,000, filed Feb. 12, 2009, entitled PORTABLE ELECTRONIC DEVICE CASES AND CASE ATTACHMENT APPARATUSES, the entirety of which is incorporated herein by reference.

STATEMENT REGARDING FEDERALLY SPONSORED RESEARCH OR DEVELOPMENT n/a

FIELD OF THE INVENTION

The present invention relates to portable device cases, and in particular, to a low profile rotatable clip for use with portable electronic device cases.

BACKGROUND OF THE INVENTION

Recent statistics show that the number of cellular telephone users in the United States alone is about 203 million. The emergence of the cellular telephone and portable digital assistants ("PDA"s) as widely embraced technologies has led to the emergence of ancillary markets, such as the market for cellular telephone accessories. As more and varied cellular devices reach the market, the need for smaller and more streamlined accessories has developed.

Additionally, mobile communication devices, such as cell phones, have become increasingly compact, having a length and width only a few inches and a depth of less than an inch. Due to this decrease in size, some people prefer to carry their mobile communication devices on their person or accessories. For example, men often carry their cell phones on a belt about their waist and women often clip their cell phones to shoulder straps for handbags. As such, various clips for cell phones have been devised. One form of belt clip requires that the cell phone itself have a certain attachment that interlocks with a complementary attachment on the belt clip. These types of cell phone belt clips include a first clip engageable with the person's belt and a complementary second clip coupled to the cell phone case which engages the first clip. This form of belt clip, however, can be complicated to use since it typically consists of multiple separate pieces and the user is required to place a first clip on his belt before the cell phone is attached to the belt, making accessing the device difficult.

Another form of belt clip is a clip assembly permanently welded to the back of the cell phone and/or cell phone case. This requires that the device case be fabricated along with the clip assembly. This kind of clip assembly typically includes a base element that is permanently affixed to a prefabricated a locking mechanism, which is coupled to a clip. Because the locking mechanism is prefabricated, the clip that is affixed to the lock must also be prefabricated along with the device case, to appropriately mate with the lock. This makes the overall device case large, and the riveting process difficult, because the clip impedes affixation of the base element to the device case. This drawback limits the type of clip that can be affixed to the base element and further limits any desired range of motion of the clip based on the particulars of the device case.

Further, the cumbersome nature and size of these clips makes it more difficult to carry the cell phone in a pant pocket or a small purse.

It is also noted that many clips include metallic components. These metallic components can interfere with the transmission and reception of radio signals from the mobile device, thereby impeding the performance of the mobile device. Also, clip devices that contain metal components are known to have adverse effect on the specific absorption rate ("SAR") of wireless signals by the human body as a result of amplification of the SAR levels. Thus, there is a need to overcome the problems with the prior art, and more particularly for a low profile rotatable device case clip that is fabricated independently of the device case to allow for greater versatility in clipping the device case to a desired item. There is also a need for a device case clip that does not adversely affect radio signals emitted or received from the mobile device.

SUMMARY OF THE INVENTION

The present invention advantageously provides a method and device for a low profile rotatable device clip for use with portable electronic device cases. The clip assembly includes a base having an opening there through. The base is mountable to the mobile device case. An arm has a recess and a projection that is disposable within the opening. The arm is rotatable about the base. A lock is insertable into the recess to rotatably secure the arm to the base.

In accordance with another embodiment, the present invention provides a method in which a base is mounted to a mobile device case. An arm is engaged the base, such that the arm is rotatable about the base. The base is then rotatably locked to the arm.

In yet another embodiment, the present invention provides a clip assembly. The clip assembly includes a base mountable to the mobile device case, the base has an opening there through and a plurality of detents radially disposed about the opening. The base further includes a flared edge on the inner part of the opening. An arm is also included. The arm includes a projection with a plurality of radially disposed grooves. The arm further includes a recess and is rotatable about the base. The arm further comprises a tongue engageable with the detents. A lock including a plurality of tabs is included and is engageable with the grooves and with the flared edge. The lock further includes a substantially flat portion and the arm includes a flat surface, such that when the lock engages the flared edge, the substantially flat portion is substantially coplanar with the flat surface of the arm. A fastening support element engageable with the arm is included. The fastening support element has a pair of buttons and a substantially planar portion. A fastener is included in which the fastener defines hooks for receiving the pair of buttons and a rib for receiving the substantially planar portion.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

As used herein, relational terms, such as "first" and "second," "top" and "bottom," and the like, may be used solely to distinguish one entity or element from another entity or element without necessarily requiring or implying any physical or logical relationship or order between such entities or elements.

Figure 1:
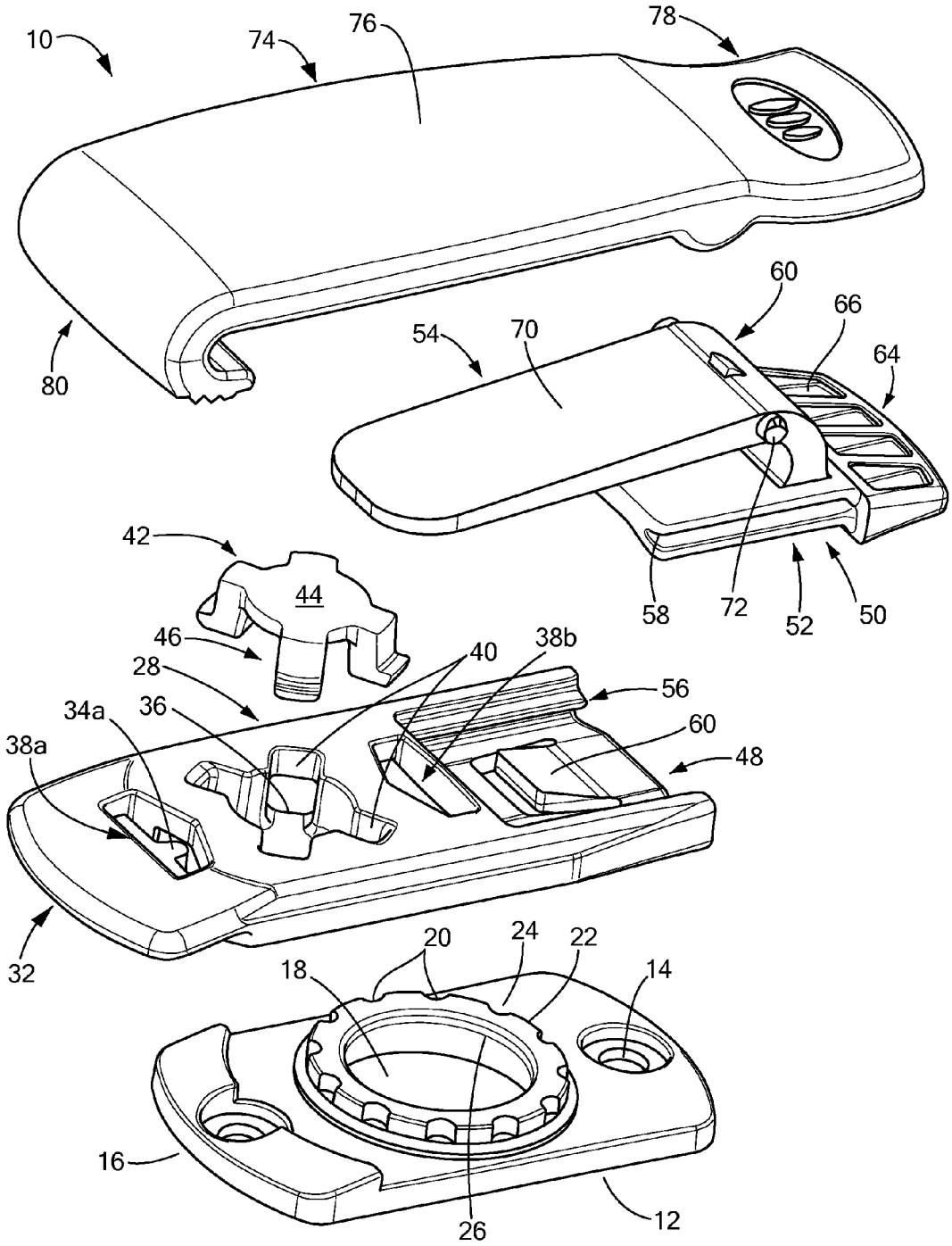
FIG. 1 is a perspective of an embodiment of a clip assembly of the present invention in a disassembled state.

Referring now to the drawing figures in which like reference designators refer to like elements, there is shown in FIG. 1 an illustration of a perspective view of a clip assembly of the present invention in a disassembled state generally referred to as "10." The various components of the clip assembly 10 may be, for example, plastic or other light-weight durable materials. The use of plastic for all or some of the components of clip assembly 10 minimizes or eliminates adverse affects on the Specific Absorption Rate ("SAR") of radio frequency energy emitted by a wireless phone onto the user's body. The use of plastic components for the clip assembly 10 does not have an adverse effect on the SAR and does not adversely impact the transmission and reception of the wireless radio signals by the mobile device.

The clip assembly 10 may include a base 12, which may be affixed to a mobile device case, for example, by riveting, sewing, welding, and the like. Alternatively, the base 12 can be molded into a device case forming a unitary structure and eliminating the need to sew or rivet the base 12 into a mobile device case. The base 12 may be substantially rectangular in shape with curved edges or any shape, which can be readily affixed to a mobile device case. The base 12 may define one or more through holes 14 through which a screw, bolt, rivet, or other affixation element may be used to affix or mount the base 12 to a mobile device. For example, the base 12 may define two through holes 14, each through which rivets may penetrate to affix the base 10 to the mobile device case. The base 10 may further define a lip 16 at one of its ends. The lip 16 may be curved and aid in defining at least one of the through holes 14. The lip 16 may further operate to provide a flush contact surface with other components of the clip assembly 10. The lip 16 may be raised from the base 12 such that the height of the lip 16 may be greater than the height of the base 12.

Figure 2:
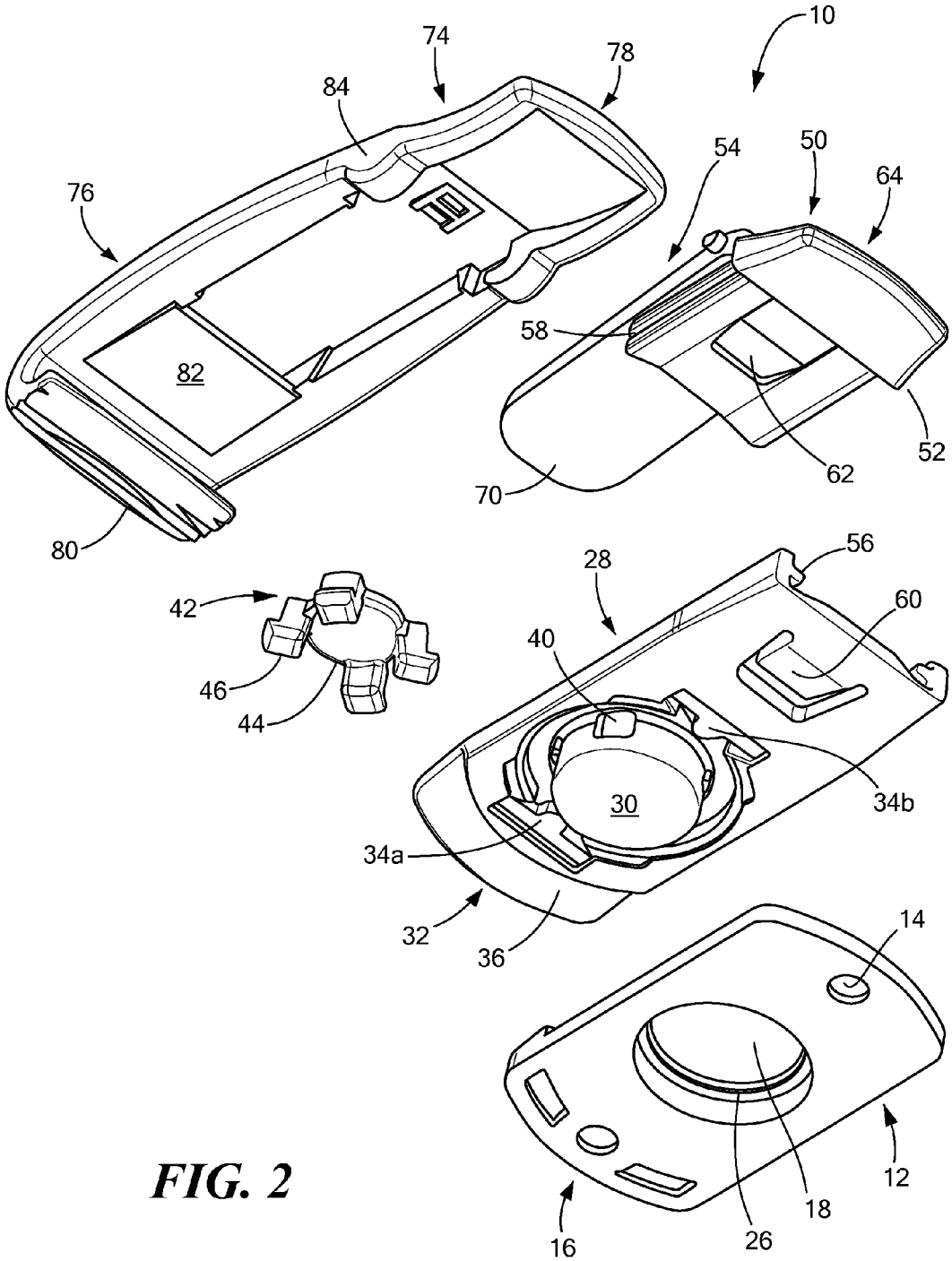
FIG. 2 is another perspective view of the disassembled clip assembly shown in FIG. 1.

The base 12 may further define an opening 18. The opening 18 may be substantially circular or any shape. A plurality of detents 20 may be disposed about the opening 18. For example, as shown in FIG. 1, the detents 20 may be circumferentially disposed about the opening 18. Each detent 20 may be raised above the surface of the base 12 and operate as a catch to control the movement of other components of the clip assembly 10, as discussed in more detail below. For example, as shown in FIG. 1, twelve detents 20 are shown radially disposed about the base 12. Each detent 20 may include a substantially rectangular raised portion 22 separated by a substantially concave portion 24, or any shaped portion that allows resistive rotation about the opening 18 between the substantially rectangular raised portions 22. The opening 18 may further define a flared edge 20 (seen in FIG. 2) circumferentially disposed about the opening 18 and extending inward towards the center of the opening 18. The flared edge 20 may be disposed on the upper portion of the opening 18 and may engage other components of the clip assembly 10 as discussed in more detail below.

The clip assembly 10 may further include an arm 28 engageable with the base 12. The arm 28 may substantially rectangular in shape, or any shape, and may have a surface area slightly larger than the base 12. The arm 28 may define a projection 30 (seen in FIG. 2) which extends outward from approximately the center of the arm 28. The projection 30 may be substantially circular in shape and may be substantially concentric to and disposable within the opening 18. The arm 28 may further include an elongate extension 32 protruding from the arm 28. The elongate extension 32 may be defined with substantially the same curvature as the lip 16. For example, the arm 28 may be engaged to the base 12 such that the outer edge portions of elongate portion 32 and the lip 16 are flush with each other.

Figure 3:
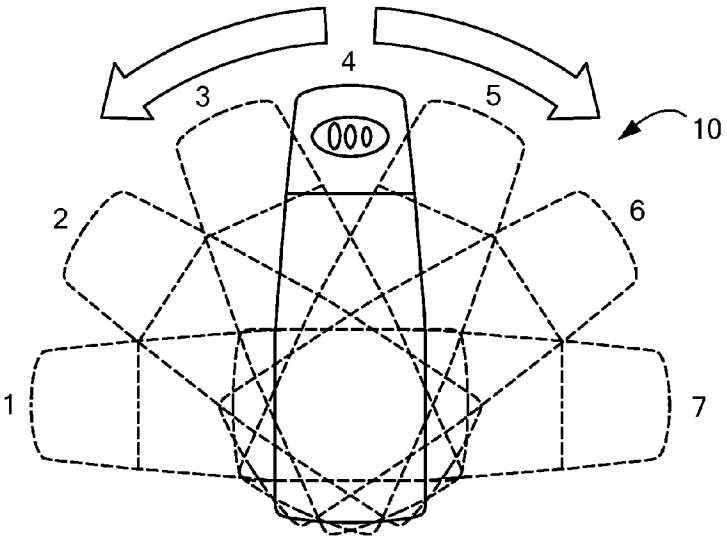
FIG. 3 is a top view of the assembled clip assembly shown in FIG. 1 showing the rotation of the arm about the base.

The arm 28 may further define a pair of diametrically opposed tongues 34*a* and 34*b* (referred to collectively as "tongues 34") which may be disposed on opposite sides of a recess 36 (discussed in more detailed below) defined by the projection 30. The tongues 34 may be recessed within cavities 38a and 38b (referred to collectively as "cavities 38") defined by the arm 28. The tongues 34 may operate to resist the rotational movement of the arm 28 when engaged to the base 12. For example, as the arm 28 rotates about the base 12, the tongues 34 may mate, or otherwise engage with the concave portion 24 of each detent 20, and operate to provide inertia, such that a torque is needed to rotate the arm 28 from one detent 20 to another. For example, in an embodiment where twelve detents 20 are circumferentially disposed about the opening 18, the arm 28 may be securably rotatable to twelve positions about the base 12. In the embodiment shown in FIG. 3, the arm 28 may be securably rotatable either clockwise or counter-clockwise about the base 12 in seven exemplary positions identified as positions 1, 2, 3, 4, 5, 6, and 7. The arm 28 may be secured into each of these positions until rotated to a different position by application of a torque to the arm 28.

Referring again to FIG. 1, the projection 30 may define a plurality of radially disposed grooves 40 disposed within recess 36 (seen in FIG. 2) which may be substantially rectangular in shape, or any shape. The grooves 40 and the recess 36 provide a predefined space for receiving a lock 42. The lock 42 is insertable within the recess 36 and securably locks the arm 28 to the base 12 when the arm 28 is engaged to the base 12. The lock 42 may include a substantially flat portion 44, and a plurality of tabs 46 extending from the substantially flat portion 44. The lock 42 may be inserted into the recess 26 by disposing the lock within the recess 36 and aligning the plurality of tabs 46 with the grooves 40, which may have similar dimensions to that of the plurality of tabs 46. In an exemplary embodiment, the lock 42 includes four tabs 46 extending from the substantially flat portion 44 and the recess 36 defines four complementary grooves 40 for receiving the four tabs 46. Once the lock 42 is aligned with the recess 36, a force may be applied to the substantially flat portion 44, which may cause the plurality of tabs 46 to penetrate the grooves 40 and engage the flared edge 26 of the opening 18.

This operates to rotatably lock the base 12 to the arm 28. When lock 42 is fully inserted within the recess 36, and the plurality of tabs 46 engage the flared edge 26, the surface of the substantially flat portion 44 may be substantially coplanar with the surface portion of the arm 28 that defines the recess 36. This aids in providing a low-profile for the clip assembly 10.

Continuing to refer to FIG. 1, the arm 28 may further define a depression 48 at an end portion of the arm 28. The depression 48 may be substantially rectangular in shape and may engage other components of the clip assembly 10. For example, the depression 48 may engage a fastening support element 50 defining a first portion 52 and a second portion 54. The first portion 52, which may be substantially rectangular in shape and define similar dimensions to that of the depression 48, may be slidably received within a pair of tracks 56 defined by the depression 48. The tracks 56 may further extend along the sides of the depression 48. The tracks 56 are operable to slidably receive a complementary pair of indentations 58 defined by the first portion 52 (seen in FIG. 2). The indentations 58 may slide along the tracks 56 and substantially span the length of the depression 48.

Continuing to refer to FIG. 1, the arm 28 may further include a resilient flap 60, which may be pressable and disposable within the depression 48. The flap 60 may be substantially rectangular, or any shape, and may be urged from a raised positioned to a pressed position by the application of force to a portion of the flap 60. In the embodiment shown in FIG. 1, the flap 60 is disposed at approximately the center of the depression 38 and is biased in a raised position. The first portion 52 may define a complementary divot 62 (seen in FIG. 2) sized to receive the flap 60 as the first portion 52 is slidably received within the depression 48. For example, as the first portion 52 is inserted within the depression 48, the flap 60 may be in a pressed position resulting from a force applied by the first portion 52. When the flap 60 engages the divot 62, the force applied to the flap 60 may be abated and the flap 60 may return to its original biased state and snap-fit into the divot 62, securing the fastening support element 50 to the arm 28.

It is further contemplated that the fastening support element 50 may be either permanently affixed to the arm 28 or may be removable. In an embodiment where the fastening support element 50 is removably coupled to the arm 28, the flap 60 may be released from the divot 62 by application of an upward force to a grip 64, which is disposed at the distal end of the first portion 52. The grip 50 may extend outward from the distal end of the first portion 41 and provide a gripping surface for insertion and removal of the fastening support element 40 from the arm 20. The grip 64 may further define a plurality of inter-digitated slices 66 that span the grip 50. The inter-digitated slices 66 may aid in transmitting a force along the first portion 52, such that application of an upward force to the grip 64 may cause a downward force to be applied on the flap 60, pressing the flap 60 against the depression 48. When the flap 60 is in a pressed position, the first portion 52 may be released from the arm 28.

Figure 4:
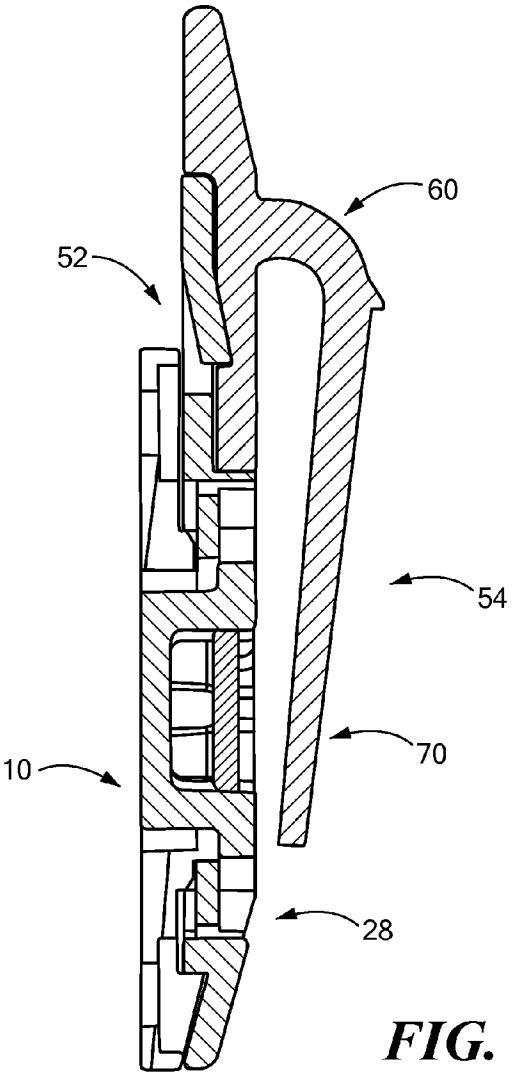
FIG. 4 is a longitudinal cross-section of the fastening support element engaged with the arm.

Continuing to refer to FIG. 1, the second portion 54 may define a curved portion 68 and a substantially planar portion 70. The curved portion 68 may be affixed to the first portion 52 and may be substantially arcuate in shape. The curved portion 68 may include buttons 72 protruding from the sides. The buttons 72 may be substantially cylindrical and may be pressable and insertable within the curved portion 68. For example, as shown in FIG. 1, the curved portion 54 includes two buttons 72, one on each side. The substantially planar portion 70 may extend from the curved portion 68 and may be angled toward the arm 28. For example, as shown in FIG. 4, when the first portion 52 is inserted within the depression 48, the substantially planar portion 70 may be angled toward the arm 28. The substantially planar portion 70 may also be biased such that it may operate as a clip and engage, for example, a belt of straps of a hand bag.

The buttons 72 may be engaged to a fastener 74, which operates to clip the clip assembly 10 to a desired location. The fastener 74 may define a substantially rectangular portion 76, a substantially concave portion 78, and a hook portion 80. The substantially rectangular portion 76 may operate as a span between the substantially concave portion 78 and the hook portion 80. The substantially concave portion 78 may operate to provide a gripping surface to which a force may be applied to move the fastener 74.

Figure 5:
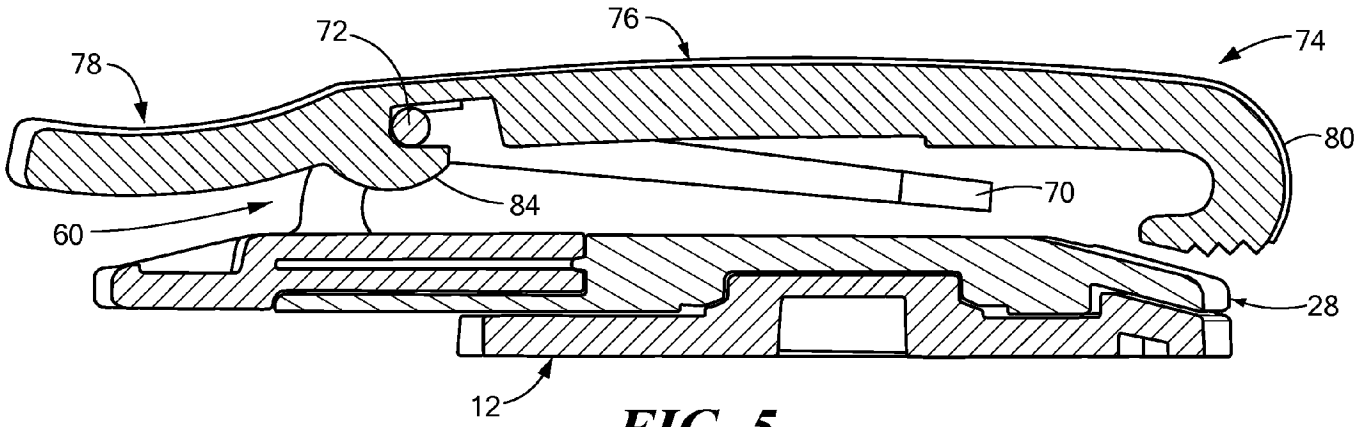
FIG. 5 is a longitudinal cross-section of the assembled clip assembly shown in FIG. 1.

The substantially rectangular portion 76 may define a rib 82 (seen in FIG. 2) defining an interior disposed on the back face of the fastener 74, the back face being defined as the face of the fastener 74 that engages the buttons 72. The substantially rectangular portion 76 may further define hooks 84 (seen in FIG. 2) on the back face which may releaseably engage the buttons 72. For example, as shown in FIG. 5, the buttons 72 are insertable with an interior portion defined by the hooks 84 such that the fastener 74 is moveable about the buttons 72. The grip 64 may be utilized to slide the fastening support element 50 into the hooks 84.

Figure 6:
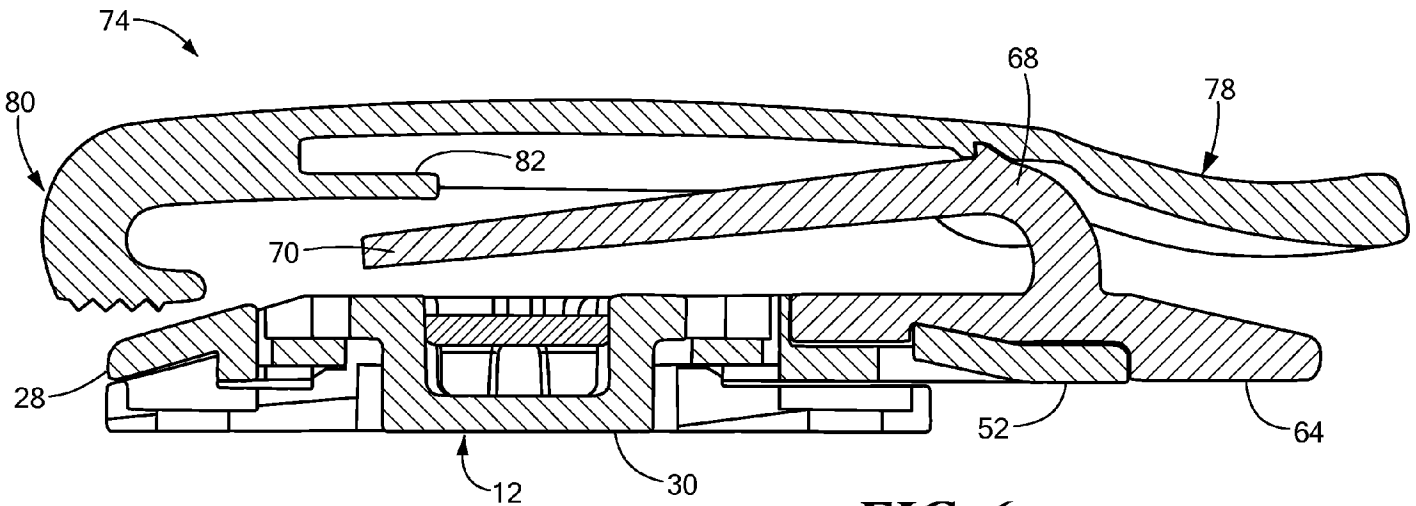
FIG. 6 is a another longitudinal cross-section of the assembled clip assembly shown in FIG. 1 showing the rib.
Figure 7:
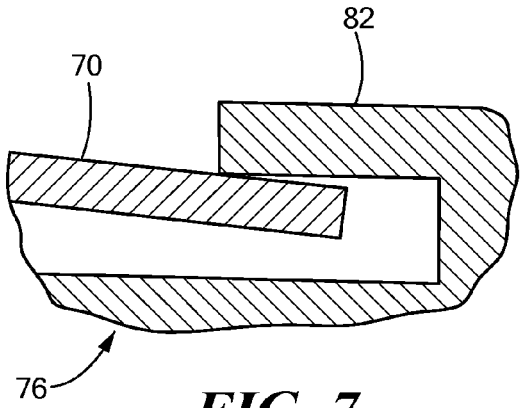
FIG. 7 is a side view of the rib of FIG. 6.

Referring now to FIG. 6, wherein the buttons 72 are shown engaged to the hooks 84, the substantially planar portion 70 of the fastening support element 50 may be biased in the direction towards the arm 28. The substantially planar portion 70 may then be urged into the interior portion of rib 82 (shown in FIG. 7). Disposing the substantially planar portion 70 within the rib 82 biases the fastener 74 towards to the arm 28 and provide a force back towards the hooks 84 such that the buttons 72 remain wedged within the hooks 84. In such a position, the hook portion 80 of the fastener 74 may be diametrically opposed from the curved portion 68 such that items may be enclosed within the clip assembly 10.

Figure 8:
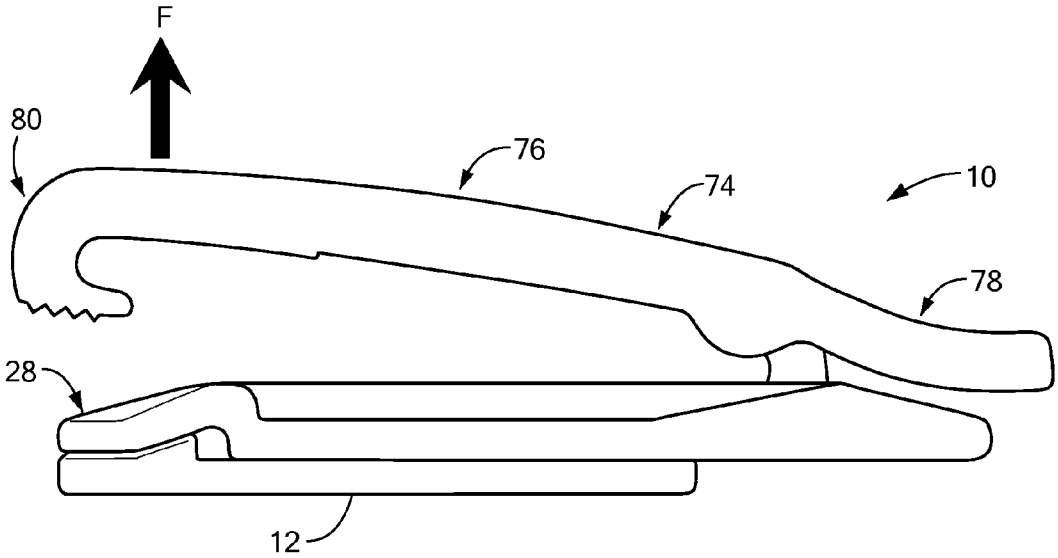
FIG. 8 is a side view of the assembled clip assembly shown in FIG. 1 showing the application of a force F to the fastener.
Figure 9:
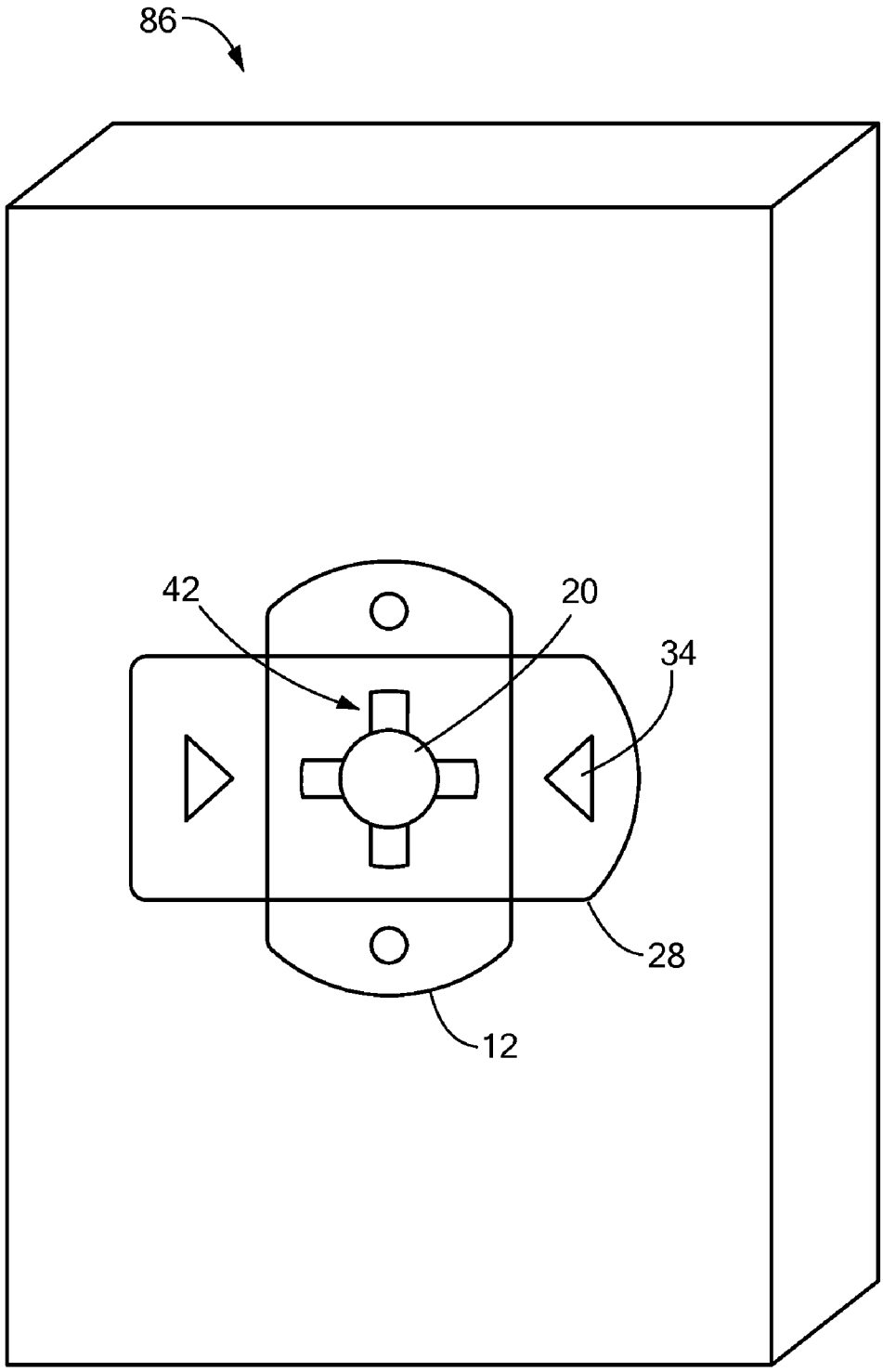
FIG. 9 is perspective view showing the clip assembly shown in FIG. 1 assembled and affixed to a mobile device case.

Referring now to FIG. 8, application of a force F to the substantially concave portion 78 may cause the fastener 74 to be pulled outwardly from the clip assembly 10. During application of force F, items such as waist belt, bag straps may be positioned between the fastener 74 and the arm 28. Upon cessation of the force F, the fastener 74 may return to its original biased and enclose the items to which the clip assembly 10 may be attached. This configuration enables the clip assembly 10 to have a low-profile and with respect to the device case and large fastening strength because the fastener 74 may extend approximately a few millimeters from the arm 28 in its original biased position. The assembled clip assembly 10 having list low-profile is shown in FIG. 9 affixed to a device case 86.

Figure 10:
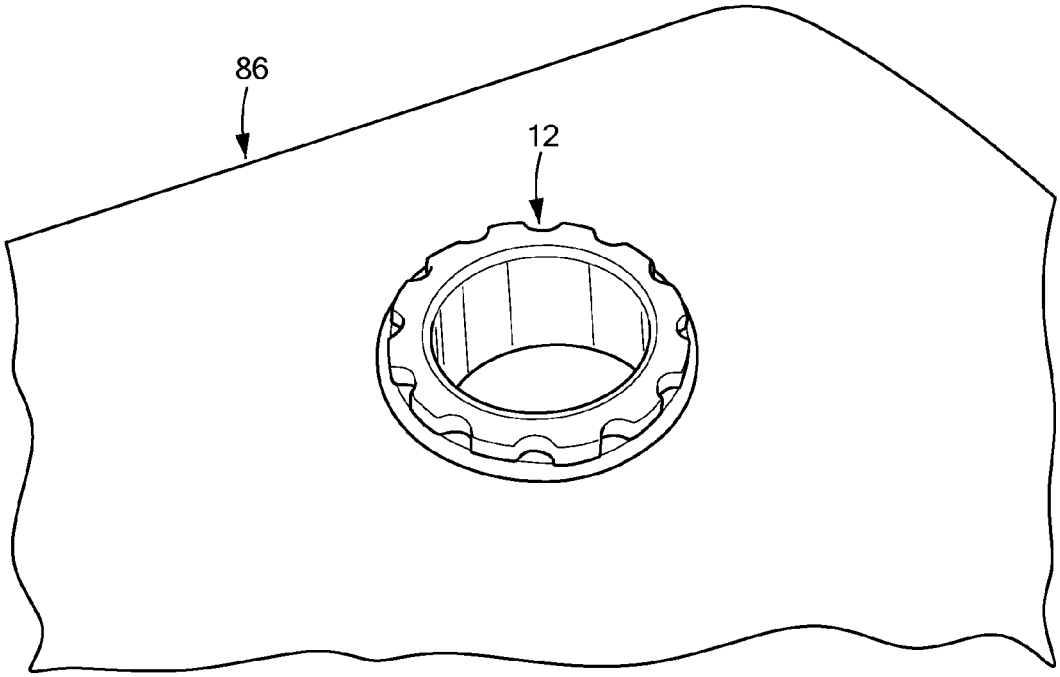
FIG. 10 is a perspective view showing the clip assembly molded into a device case.

Referring now to FIG. 10, the base 12 may alternatively be molded directly as part of the device case 86 during fabrication of the device case 86. In such an embodiment, the base 12 may be substantially coplanar with the surface of the device case 86 and the plurality of detents 20 may be raised from the surface of the device case 86. A variety of differently shaped base elements 12 may be molded into the device case 86 to accommodate a variety of clip assemblies 10.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A clip assembly for a mobile device case comprising:

a base having an opening there through, the base being mountable to the mobile device case;

an arm including a projection disposable within the opening, the projection including a recess defined by a substantially flat bottom surface and a perimeter wall, the perimeter wall including a plurality of grooves, the arm being rotatable about the base and having a depression; and a lock being insertable into the recess to secure the arm to the base, the lock including a plurality of tabs engageable with the plurality of grooves, the lock further including a substantially flat portion, the plurality of tabs extending from the substantially flat portion;

when the lock engages the base through the opening, the substantially flat portion is substantially co-planar with the flat surface of the arm; and a fastening support element slideably receivable within the depression.

2. The clip assembly of claim 1, wherein the base further includes a plurality of detents circumferentially disposed about the opening.

3. The clip assembly of claim 2, wherein the arm further comprises a tongue engageable with the detents.

4. The clip assembly of claim 1, wherein the base further includes a flared edge on an inner part of the opening, and wherein the tabs are engageable with the flared edge.

5. The clip assembly of claim 1, wherein the base is integrated with the device case.

6. The clip assembly of claim 1, further including a fastener engageable with the fastening support element.

7. The clip assembly of claim 6, wherein the fastening support element has a pair of buttons, and wherein the fastener has hooks for receiving the buttons.

8. The clip assembly of claim 7, wherein the fastening support element includes a substantially planar portion, and wherein the fastener includes a rib defining a cavity for receiving the substantially planar portion.

9. A clip assembly for a mobile device case, the clip assembly comprising:

a base being mountable to the mobile device case, the base having:

an opening there through, the opening having a flared edge on an inner part of the opening; and a plurality of detents radially disposed about the opening;

an arm rotatable about the base, the arm including:

a projection having a substantially flat bottom surface and a perimeter wall that together define a recess, the perimeter wall including a plurality of grooves;

a flat surface, and a tongue engageable with the plurality of detents, a lock including:

a plurality of tabs engageable with the grooves and with the flared edge, and a substantially flat portion from which the plurality of tabs extend, such that when the lock engages the flared edge, the substantially flat portion is substantially co-planar with the flat surface of the arm;

a fastening support element slideably receivable with the arm, the fastening support element having a pair of buttons and a substantially planar portion; and a fastener defining hooks for receiving the pair of buttons and a rib defining a cavity for receiving the substantially planar portion.

* * * * *